US012004670B2

(12) United States Patent
Gunn

(10) Patent No.: US 12,004,670 B2
(45) Date of Patent: Jun. 11, 2024

(54) AUTOMATED MAIL AND KEY STORAGE APPARATUS

(71) Applicant: Cameron Todd Gunn, Miami, FL (US)

(72) Inventor: Cameron Todd Gunn, Miami, FL (US)

( * ) Notice: Subject to any disclaimer, the term of this patent is extended or adjusted under 35 U.S.C. 154(b) by 137 days.

(21) Appl. No.: 17/693,960

(22) Filed: Mar. 14, 2022

(65) Prior Publication Data

US 2023/0284812 A1 Sep. 14, 2023

(51) Int. Cl.
*A47G 29/124* (2006.01)
*A47G 29/10* (2006.01)
*A47G 29/22* (2006.01)

(52) U.S. Cl.
CPC ..... *A47G 29/124* (2013.01); *A47G 29/10* (2013.01); *A47G 29/22* (2013.01)

(58) Field of Classification Search
CPC ..... A47G 29/124; A47G 29/10; A47G 29/20; A47G 29/22; A47G 29/30; A47G 29/141; A47G 2029/144
USPC ..... 232/45
See application file for complete search history.

(56) References Cited

U.S. PATENT DOCUMENTS 7,182,246 B1 * 2/2007 Sievel ..... A47G 29/22 232/47
7,913,898 B2 * 3/2011 Frankenberg ..... A47G 29/22 312/297
9,211,025 B1 * 12/2015 Elhawwashy ..... A47G 29/20
10,028,606 B1 * 7/2018 Ritchie ..... G07C 9/00896
10,147,067 B2 * 12/2018 Pleis ..... A47G 29/1225
10,512,352 B1 * 12/2019 Torres ..... A47G 29/22
10,624,484 B1 * 4/2020 Mountford ..... B60P 3/03
2008/0258869 A1 * 10/2008 Ognjenovic ..... G07C 9/00896 340/5.73
2013/0127594 A1 * 5/2013 Sato ..... G07C 9/00896 340/5.73
2017/0228692 A1 * 8/2017 Pargoe ..... H04W 4/021
2018/0352988 A1 * 12/2018 Ortiz ..... A47G 29/141
2019/0343317 A1 * 11/2019 Cantrell ..... G07C 9/00563
2020/0046155 A1 * 2/2020 Aresu ..... A47G 29/12
2020/0130893 A1 * 4/2020 Väin ..... G05D 1/021
2020/0397172 A1 * 12/2020 Kennett ..... G07C 9/00896
2021/0015286 A1 * 1/2021 McCloskey, III ..... A47G 29/22
2021/0068574 A1 * 3/2021 Riepe ..... E05G 1/026

* cited by examiner

*Primary Examiner* — William L Miller
(74) *Attorney, Agent, or Firm* — Vladimir Postnikov

(57) ABSTRACT

Disclosed is an automated key and mail storage apparatus that includes a container with one open side; a flexible cover; a mail holder; and a plurality of key holders. The magnetic strip secures a plurality of keys within the key and mail storage apparatus. The keys include metal rings that adhere to the magnetic strip. The motor end brackets is attached at each end at the top of the container to support a shaft. Attached to the shaft is motor which rotates the shaft. The flexible cover is attached to shaft and rolls up and down based on the motor rotation. The mail holder is attached to the back of container to provide storage of the mails. The key holders are attached to the back of container to provide storage of the keys.

16 Claims, 12 Drawing Sheets

AUTOMATED MAIL AND KEY STORAGE APPARATUS

BACKGROUND

Technical Field

The invention presented herein is generally directed towards a key and mail storage. More particularly, but not limited to, an automated key and mail storage apparatus.

Description of the Related Art

There are various mail and key holders on the market that will store mail and keys that are table versions or wall-mounted. They are placed in central locations such as in the entranceway of the home or office. They provide a central location to store keys and mail. They consist of a container or simply bent plastic or steel that forms a place to insert the mail. They are often supplied with hooks or magnetic stripes to hold the keys for wall-mounted versions. The tabletop versions of the mail holder could simply consist of an open-top container or container with an open top and sides to allow the mail to be stored. For keys, they could be stored in a simple dish or there are containers for keys which are boxes. There are key boxes on the market keeping the keys hidden and in a commonplace. It is a common occurrence for a user to be in a hurry in the morning and cannot find the keys. These devices provide an easy-to-use location for the keys to be stored and found easily.

Although the above-mentioned products provide the utility of storage, they are often not wanted due to the exposure of the keys and or mail. It looks cluttered when users want a neat and organized look in their home or office.

Thus, in view of the above, there is a long-felt need in the industry to address the aforementioned deficiencies and inadequacies.

The approaches described in this section are approaches that could be pursued, but these are not necessarily approaches that have been previously conceived or pursued. Therefore, unless otherwise indicated, it should not be assumed that any of the approaches described in this section qualify as prior art merely by virtue of their inclusion in this section.

SUMMARY

An automated key and mail storage apparatus are provided, as shown in and/or described in connection with at least one of the figures.

One aspect of the present disclosure relates to an automated key and mail storage apparatus that includes a back panel; a top panel; a bottom panel; a right-side panel; a left side panel; a front left panel; and a front right panel; a magnetic strip; a right motor end bracket; a second end bracket; a flexible cover; a mail holder; and a plurality of key holders. The back panel, top panel, bottom panel, right-side panel, left side panel, front left panel, and front right panel are connected to form a container. The magnetic strip secures a plurality of keys within the key and mail storage apparatus. The keys comprise one or more metal rings that adhere to the magnetic strip. The left motor end bracket is attached to the top panel at the left side panel of the top panel to support a shaft. The right motor end bracket is placed at an opposite end is connected to the top panel. The left motor end bracket and the right motor end bracket comprise a plurality of holes to support the shaft. The flexible cover is attached to the shaft with glue and rolled up around the shaft. The flexible cover covers an open side of the container. The mail holder is attached to the back panel to provide storage of one or more mails. The key holders are attached to the back panel to provide storage of the keys.

Various embodiments of the key and mail storage apparatus are shown but the primary purpose is to provide storage and hide the keys and mail, in an easy-to-use manner, from view. With the keys and mail hidden from view, there is a less cluttered look to the environment. The embodiments show a wall-mounted container with an automated front covering that opens and closes based on the user activating a proximity sensor.

In a first embodiment, the cover is flexible and is operated by a motor mechanically coupled to a shaft that has the flexible cover attached to the shaft such that the cover moves up and down or rolls up or down in the wall-mounted container. Within the wall-mounted container, there is a mail holder that holds the mail at an angle away from the cover. Also, within the container, there is a key holder which can be hooks or a magnetic strip.

In a second embodiment, the automated key and mail storage apparatus is similar to the first embodiment but has a plurality of mail holders for additional storage.

In a third embodiment, the automated key and mail storage apparatus are similar to the first embodiment except the cover is rigid and is actuated using a servo motor and linkage to open and close a rigid cover.

Other embodiments and advantages will become readily apparent to those skilled in the art upon viewing the drawings and reading the detailed description hereafter, all without departing from the spirit and the scope of the disclosure. The drawings and detailed descriptions presented are to be regarded as illustrative in nature and not in any way as restrictive.

Other features of the example embodiments will be apparent from the drawings and from the detailed description that follows.

BRIEF DESCRIPTION OF THE DRAWINGS

The accompanying drawings illustrate the embodiments of apparatuses, methods, and other aspects of the disclosure. Any person with ordinary skills in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION

The various embodiments of the key and mail storage apparatus and methods to open and close the cover are described in the manner of storing keys and mail. The present disclosures describe certain embodiments in the context of keys and mail storage due to particular utility in this context. However, the subject manner of the present disclosure can be used in many other contexts as well, including, for example, storing cell phones, storing masks, storing file folders, storing jewelry, storing magazines, etc.

Figure 1:
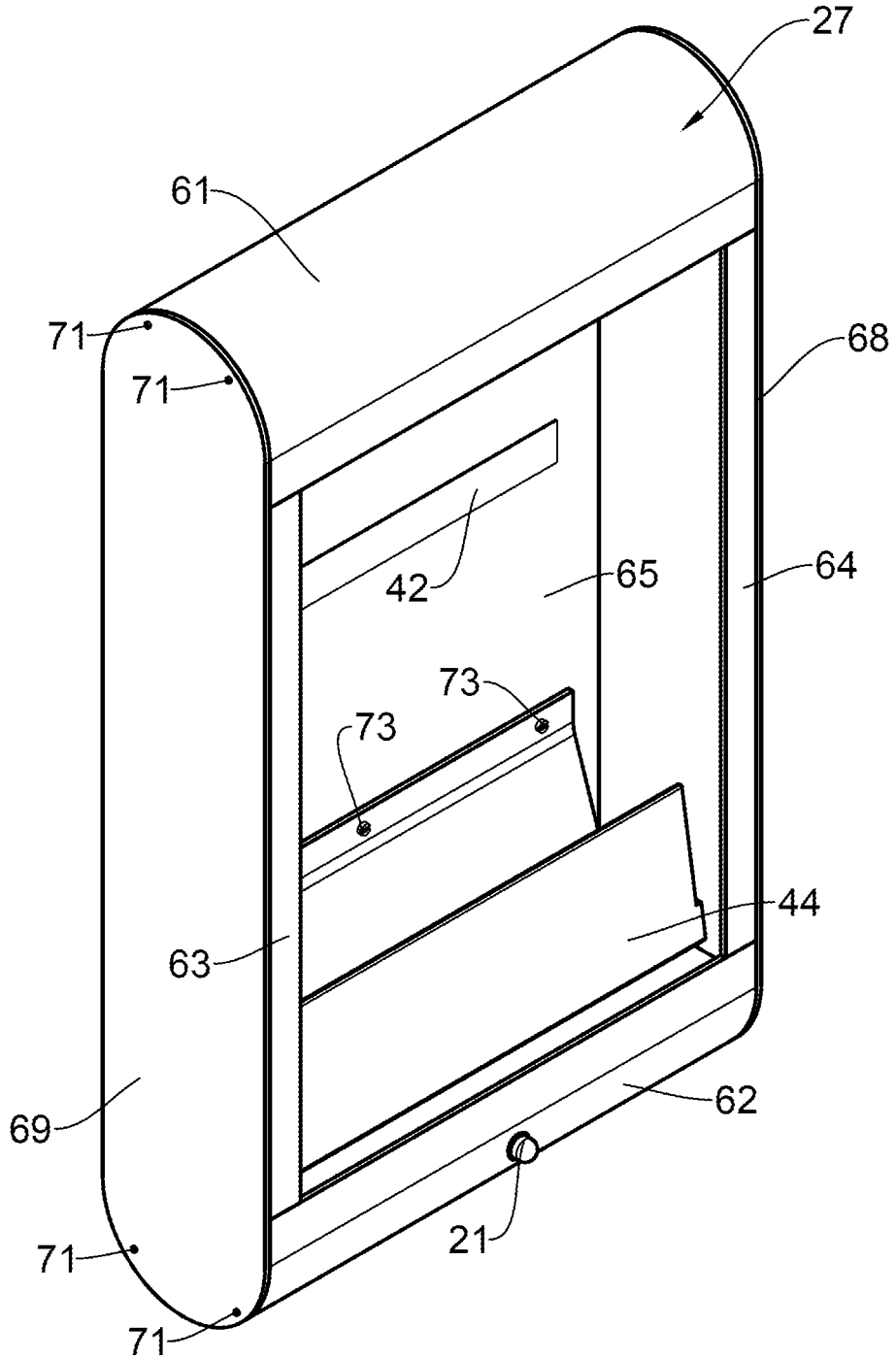
FIG. 1 illustrates a perspective view of an embodiment of the automated key and mail storage apparatus in the open condition with a magnetic strip as the key holding mechanism.
Figure 3:
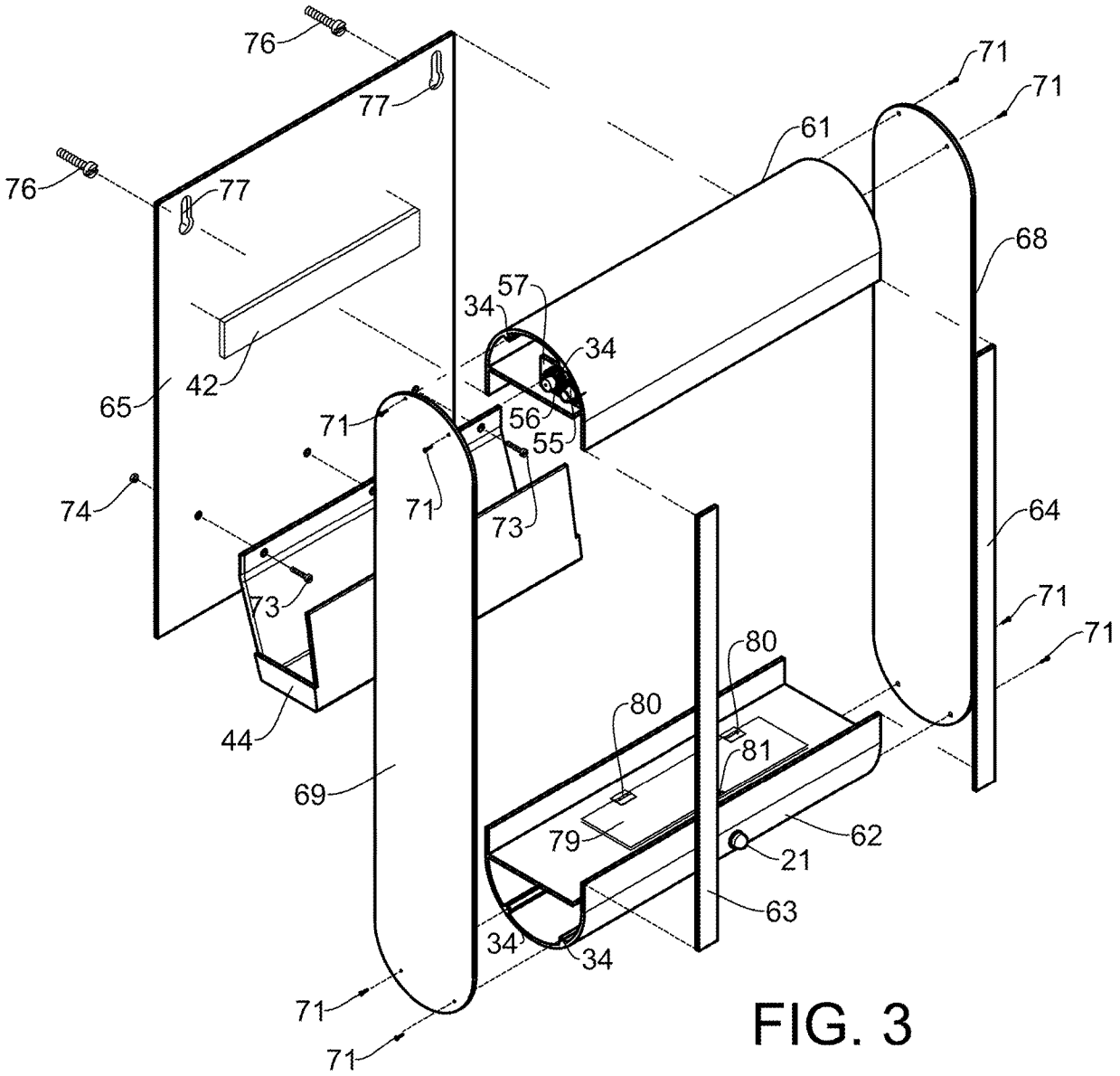
FIG. 3 illustrates an exploded view of an embodiment of the automated key and mail storage apparatus in the open condition.

With reference to FIG. 1, a key and mail storage apparatus 27 includes a back panel 65, a top panel 61, a bottom panel 62, a right side panel 68, a left side panel 69, a front left panel 63, and a front right panel 64 which form the housing of the key and mail storage apparatus 27 in the open condition. In FIG. 3 the connections between the parts are shown in detail in an exploded view. In this embodiment, a magnetic strip 42 is attached to the back panel 65 with glue 40 where the glue 40 is compatible with materials used. The magnetic strip 42 provides the method to secure keys within the key and mail storage apparatus 27. Many keys have a metal ring or metal part that will adhere to the magnetic strip 42. The glue 40 is not shown in the figures for clarity.

The key and mail storage apparatus 27 could be made of several materials including wood, plastic, aluminum, stainless steel, sheet metal, or other appropriate materials. The parts can be constructed using extrusions molds and/or molds for injection molding or can be manufactured out of flat sheets of material.

The structure of the top panel 61 and bottom panel 62 is shown as an extrusion of either plastic or aluminum in this embodiment. The back panel 65, right side panel 68, left side panel 69, front left panel 63, and front right panel 64 can be made from a flat sheet of various materials. There could be a mixture of materials used as well to obtain a certain look. Other embodiments could include different materials, as mentioned, with different manufacturing techniques. Within the key and mail storage apparatus 27, there is a mail holder 44 which is formed to hold the mail which is attached to the back panel 65 using a mail holder screw 73 and mail holder nut 74 (not shown in FIG. 1 for clarity but shown in FIG. 3). The mail holder 44 could be constructed of metal or plastic and can be manufactured in different methods such as simply bent sheet metal. A proximity sensor 21 is located in the bottom panel 62 for easy access.

Figure 2:
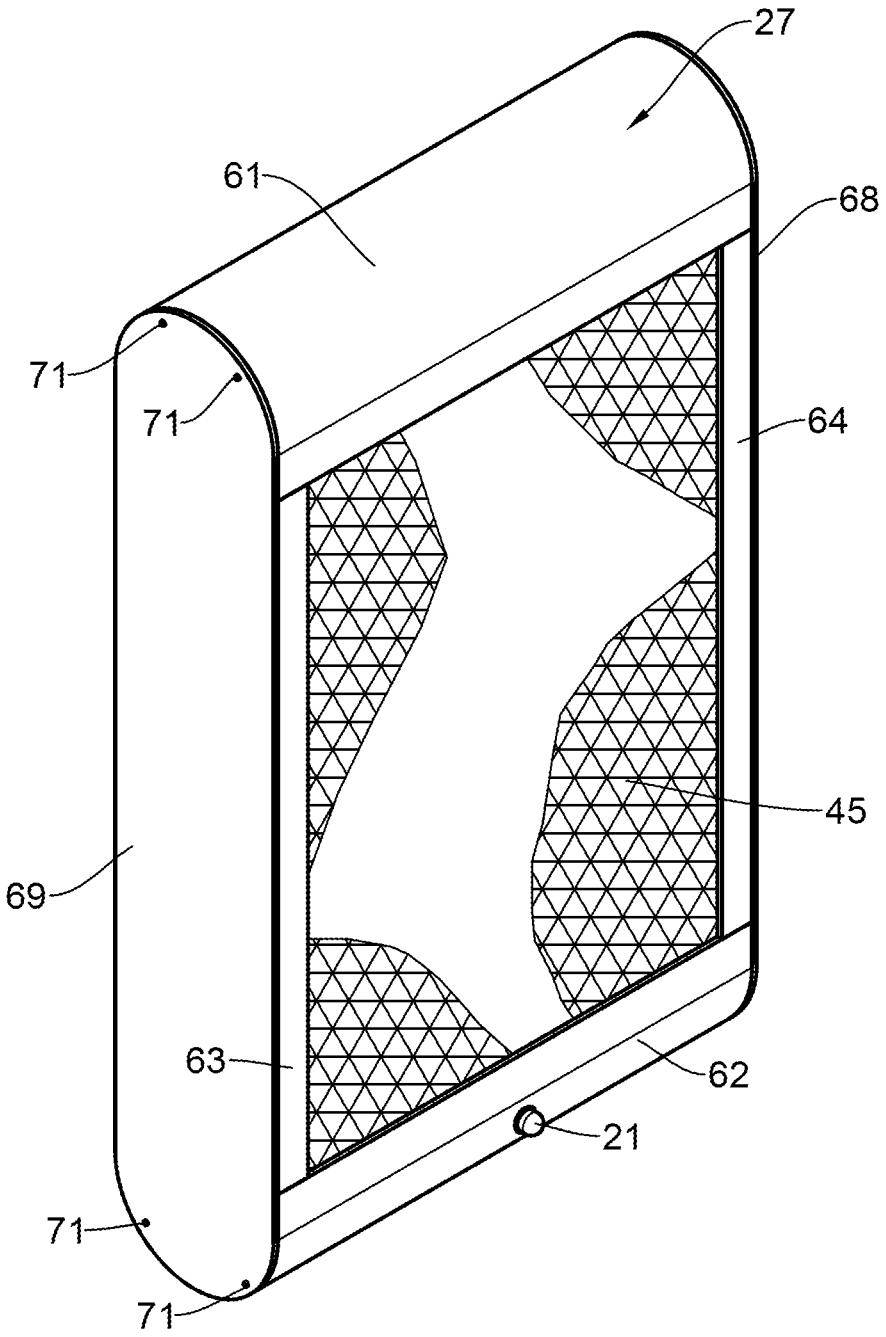
FIG. 2 illustrates a perspective view of an embodiment of the automated key and mail storage apparatus in the closed condition utilizing a flexible cover.

FIG. 2 shows the perspective view of a key and mail storage apparatus 27 in the closed position. FIG. 2 shows a key and mail storage apparatus 27 in the closed position. In this embodiment, the cover for the key and mail storage apparatus 27 is a flexible cover 45. FIG. 3 illustrates the interconnection of parts.

FIG. 3 shows the exploded view of the key and mail storage apparatus 27 in the open position. The exploded view shows the various components and where they are attached. FIG. 3 illustrates the components that can be seen. Left side panel 69 is attached to the top panel 61 with a side panel screw 71. Within the top panel 61, there is a screw boss 34 which is part of the structure of the top 61 in this embodiment. Side panel screw 71 will go through the left side panel 69 holes and into the top 61 through the screw boss 34. Similarly, to connect with the top panel 61, the left side panel 69 is attached to the bottom panel 62 utilizing side panel screw 71 and screw boss 34.

Right side panel 68 is attached to the top 61 utilizing a side panel screw 71 and the screw boss 34. Right side panel 68 is attached to bottom panel 62 utilizing a side panel screw 71 and the screw boss 34. Left side panel 69 and right side panel 68 are attached to top panel 61 and bottom panel 62 similarly. Mail holder 44 is attached to the back panel 65 using mail holder screw 73 and mail holder nut 74. In this embodiment, there are three locations with the mail holder 44 is attached to the back panel 65. Magnetic strip 42 is glued to back panel 65 at a location above the mail holder 44. Wall screw hole 77 is located at the top of the back panel 65 in two locations. Wall screw hole 77 is sized to accept wall screw 76 which will go into a wall (wall not shown) and support the key and mail storage apparatus 27 at a height appropriate for the user.

Back panel 65 is attached to the top panel 61 and the bottom panel 62 using a glue 40 in this embodiment. In different embodiments, the back panel 65 can be mechanically connected to top panel 61 and bottom panel 62 with fasteners if configured differently.

Front left panel 63 is connected to the top panel 61 and bottom panel 62 using glue 40 which provides a clean look. Similarly, front right panel 64 is connected to top panel 61 and bottom panel 62 using glue 40. As with the back panel 65 connection, the front left panel 63 and the front right panel 64 could be mechanically connected with fasteners if configured differently in another embodiment.

Shown in FIG. 3 is a left motor end bracket 57, a shaft gear 55, and a motor gear 54 within the top panel 61. Further descriptions of these parts are shown in subsequent figures.

An enclosure lid 79 is placed within the bottom panel 62. The enclosure lid 79 is connected to the bottom panel 62 with enclosure hinge 80 that is glued which opens up to access the bottom of the bottom panel 62. In addition, enclosure lid 79 has an enclosure notch 81 which allows the user to open the enclosure lid 79 using a finger or screwdriver. In subsequent figures, the items located under the enclosure lid 79 are shown such as the proximity sensor 21.

Figure 4:
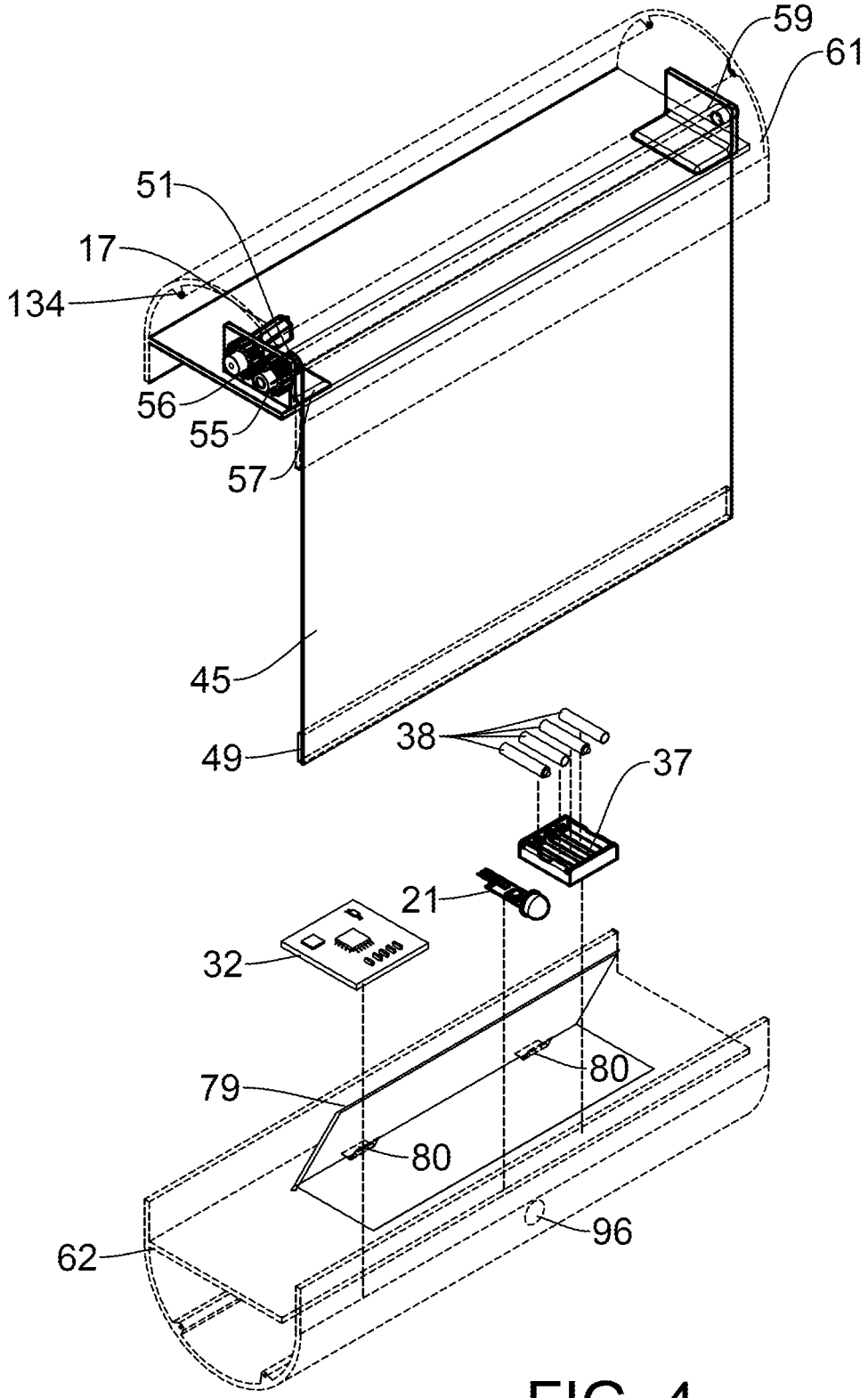
FIG. 4 illustrates a hidden view of the top and bottom section of the automated key and mail storage apparatus in the partially open condition. The view shows internal components within the top and bottom sections of the automated key and mail storage apparatus.

FIG. 4 shows the top panel 61 and bottom panel 62 in hidden view to illustrate the components within the top panel 61 and bottom panel 62. FIG. 4 also shows partially deployed flexible cover 45 with a weighted bottom 49. Within the top panel 61 is a left motor end bracket 57 is attached to the top panel 61 at the left side of the top panel 61. At the opposite end, right motor end bracket 59 is connected to the top panel 61. Shaft 51 is supported by the left motor end bracket 57 and the right motor end bracket 59. In the left motor end bracket 57 and the right motor end bracket 59 there are holes for the shaft 51 thus providing support. Flexible cover 45 is attached to shaft 51 with glue and rolled up around shaft 51.

In FIG. 4, flexible cover 45 is partially wrapped around shaft 51 and partially unrolled. At the bottom of the flexible cover 45 is a weighted bottom 49 which is glued to flexible cover 45 and provides more uniform rolling.

FIG. 4 also illustrates a motor gear 56, a shaft gear 55, and a dc motor 17 which are located at the right side of the top 61. These components will be described in more detail in subsequent sections of the specification.

FIG. 4 also illustrates the bottom panel 62 in dashed lines and the enclosure lid 79 in the open position with enclosure hinge 80 shown. In the bottom panel 62, there is a proximity sensor hole 96 which is the size of proximity sensor 21 and sticks out of the bottom panel 62. For illustrative purposes, circuit 32, proximity sensor 21, battery holder 37, and battery 38 are projected out of bottom panel 62. For clarity, the wiring of components is not shown. Circuit 32 is glued to the bottom panel 62 to maintain its position. The proximity sensor 21 is inserted into the proximity sensor hole 96 and glued to maintain position. Battery holder 37 is glued to the bottom panel 62 to maintain position. Battery 38 is illustrated as extended out of battery holder 37. The access to change battery 38 is by lifting the enclosure lid 79.

Figure 5:
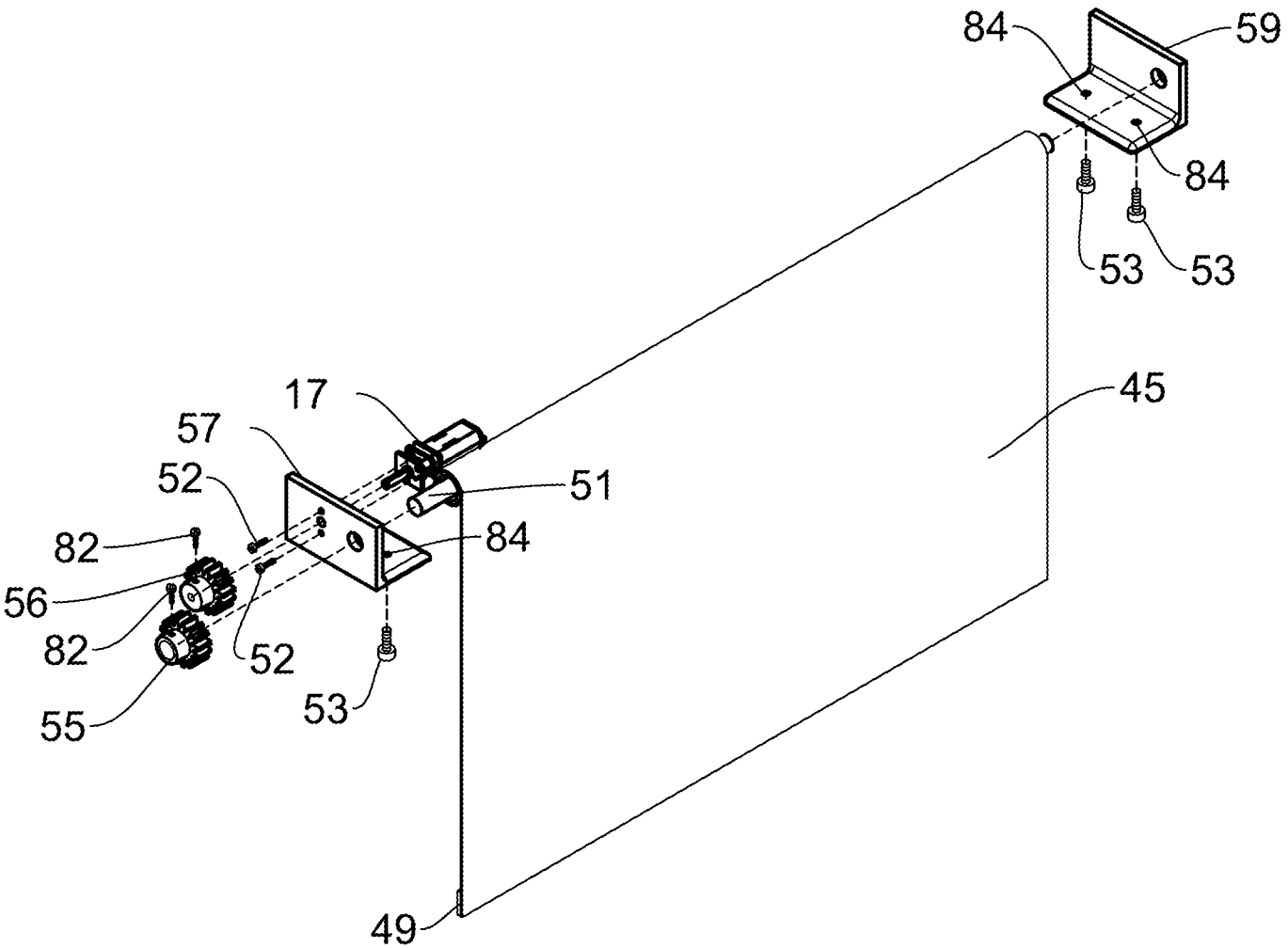
FIG. 5 illustrates an exploded view of the cover operation utilizing a flexible cover and showing the gearing and brackets to rotate the shaft within the top of the automated mail and key storage apparatus.

FIG. 5 illustrates a dc motor 17, a left motor end bracket 57, a motor gear 56, a shaft gear 55, a shaft 51, a right motor end bracket 59, a flexible cover 45, and other parts in an exploded view without the top 61. FIG. 5 is to expose and explain the flexible cover 45 operations. Left motor end bracket 57 has several holes for the dc motor 17 mountings and the shaft 51. Left motor end bracket 57 has a bracket threaded hole 84 in the bottom portion. Left motor end bracket 57 is mounted to top panel 61 (not shown in FIG. 5) by inserting a bracket screw 53 through the hole in the top panel 61 and into a bracket threaded hole 84. Bracket threaded hole 84 is required to be threaded since it is difficult to place a nut based on the shape of top panel 61 in this embodiment.

Similarly, the left motor end bracket 57, the right motor end bracket 59 has a bracket screw 53 which goes through holes in the top panel 61 (not shown in FIG. 5) and into bracket threaded hole 84. There are currently two holes in the top panel 61 for two bracket screws 53 at each end of top panel 61.

Dc Motor 17 is attached to the left motor end bracket 57 using a motor screw 52 which passes through left motor end bracket 57 through-hole into dc motor 17 which has threaded holes. For the embodiment, there are two motor screws 52. The shaft of motor 17 goes through a hole in left motor end bracket 57 such that the shaft of DC motor 17 extends to the left of the left motor end bracket 57. Attached to the dc motor 17 shaft is the motor gear 56 which has a threaded hole that allows for gear screw 82 to enter and secure the dc motor 17 shaft to the motor gear 56.

Shaft 51 has flexible cover 45 attached along shaft 51 length with exception of the ends of shaft 51. There is enough length of shaft 51 to have ends go into shaft holes in the left motor end bracket 57 and the right motor end bracket 59. Shaft 51 extends to the left of the left motor end bracket 57 to connect to shaft gear 55 where shaft gear 55 is secured to shaft 51 by using gear screw 82 which screws into a threaded hole on shaft gear 55. The DC motor 17 and shaft 51 are spaced such that the motor gear 56 meshes with shaft gear 55. The rotation of DC motor 17 shafts will rotate shaft 51 and thus roll or unroll the flexible cover 45 around the shaft 51. The materials of the gears can be metal, plastic or other appropriate materials. Although in this embodiment, the dc motor 17 is mechanically connected to shaft 51 using gears, the dc motor 17 could be directly connected to shaft 51 with a coupler. Also shown in FIG. 5 is a bottom weight 49 which is glued to flexible cover 45 to provide more even rolling. The bottom weight 49 is not always required as it will depend on flexible cover 45 materials.

Figure 6:
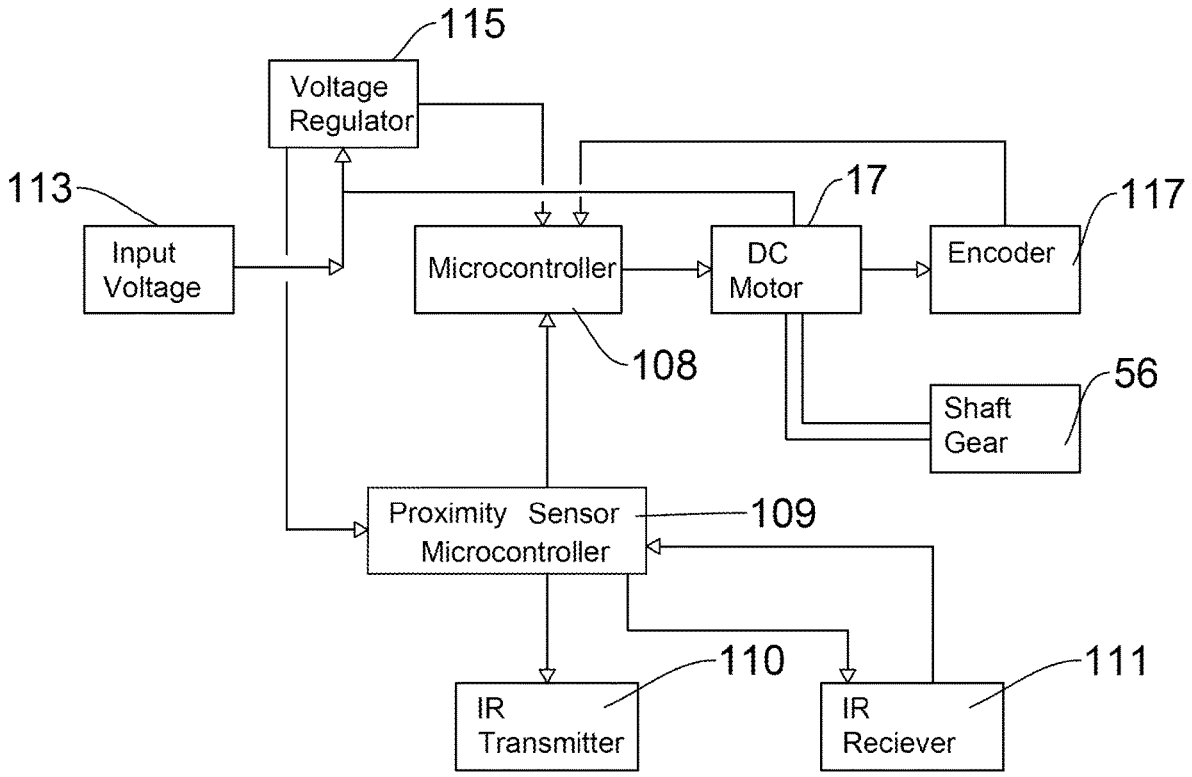
FIG. 6 illustrates an electrical representative drawing of the operation of one embodiment of the automated key and mail storage apparatus.

FIG. 6 illustrates the electronic circuitry of the key and mail storage apparatus 27. Circuit board 32, which contains the components shown in FIG. 6, can be constructed in any known manner, including in the form of a hardwired system comprising individual electronic components such as resistor, capacitors, pulse generators, operational amplifiers, logic gates, etc. Circuit board 32 can be comprised of processors, microprocessors, microcontrollers, each including the respective operating systems and software for performing the functions and control routines described below as selected in this embodiment. IR is referenced in the specification which is commonly used to abbreviate Infrared.

In FIG. 6, the IR receiver 111 detects movement when the IR transmitter 110 infrared is blocked and detected in the IR receiver 111 and sends the signal to the proximity sensor microprocessor 109. Proximity sensor microprocessor 109 sends a signal to the microprocessor 108 which will operate dc motor 17 and turn shaft gear 56 thus rolling flexible cover 45 up to open position. In FIG. 6, it is common to have proximity sensor microprocessor 109, IR transmitter 110, and IR receiver 111 within a proximity sensor 21. The same process could be achieved by incorporating proximity sensor microprocessor 109 or programing and components into microprocessor 108 or circuit board 32 and directly connecting IR transmitter 110 and IR receiver 111 to microprocessor 108. There are other types of proximity sensors on the market that could be utilized but, in this embodiment, the Infrared (IR) proximity sensor 21 is shown.

The power supply 113 provides voltage to voltage regulator 115 and directly to dc motor 17. The power supply 113 can be in form of batteries 38 or an AC to DC converter configured for the output required. As battery 38 depletes or net voltage is lower, it advisable to place voltage regulator 115 to stabilize the voltage source for the microprocessor 108 and proximity sensor microprocessor 109.

In FIG. 6, the encoder 117 is shown connected to dc motor 17 and microcontroller 108. The encoder 117, in this embodiment, is directly attached to the shaft at the back of the dc motor 17. One skilled in the art would be familiar with the operation of encoder 117 which provides relative position of the dc motor 17 shaft and also provides information on the speed of dc motor 17. Encoder 117 is quadrature so that it essentially counts the revolutions of dc motor 17 in both directions. Encoder 117 is used to determine how far the flexible cover 45 rolls up or down based on revolutions of dc motor 17 and the programming of microprocessor 108. For example, if the flexible cover 45 needs to roll up 12 inches which will require 13 revolutions of dc motor 17. The flexible cover 45 is configured to roll down the same distance for the closed position. The required revolutions are programmed into the microprocessor 108. Encoder 117 can comprise magnetics and hall effect circuit that determine the revolutions of dc motor 17. Encoder 117 could also be optical where light is emitted and a light sensor is utilized in intervals to determine the speed and relative revolutions of the dc motor 17. Microprocessor 108 will have the common H Bridge motor driver that allows the dc motor 17 to rotate in both directions. In addition, the speed that the dc motor 17 rotates can be programmed in microprocessor 108 utilizing feedback from encoder 117. The speed of dc motor 17 or RPM can be controlled to be constantly utilizing programming and feedback from encoder 117.

Figure 7:
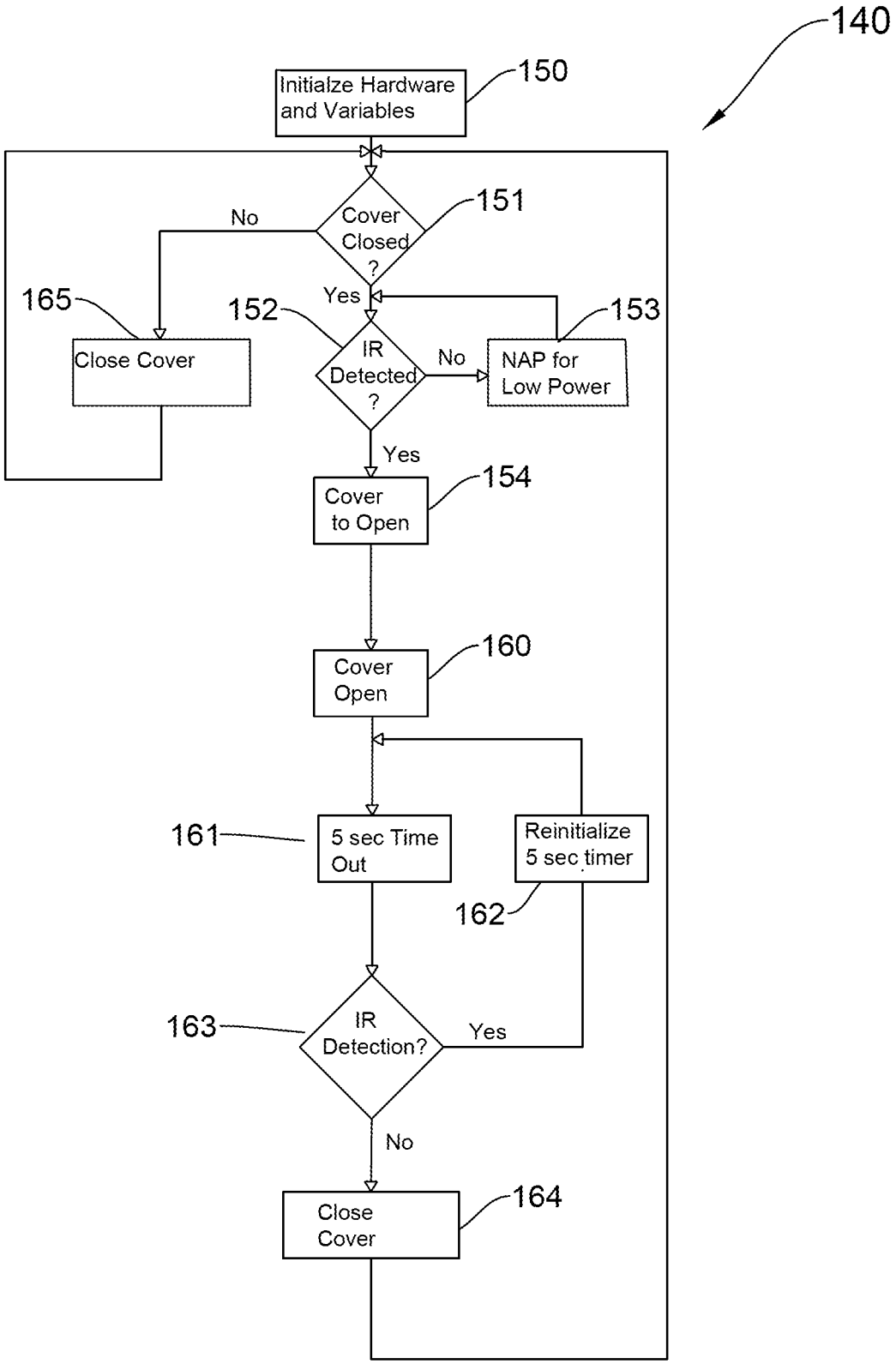
FIG. 7 illustrates the electrical logistics of the operation of the electronic components of one embodiment of the automated key and storage apparatus.

FIG. 7 illustrates the logistics of the electronic circuitry in one embodiment. With reference to FIG. 7, control routine 140 can be used with microprocessor 108. The control routine 140 can store software programmed into microprocessor 108. In FIG. 7, the control routine 140 starts in operational block 150 where the control routine 140 initializes hardware and resets variables. After operational block 150, the control routine 140 can move to decision block 151.

In decision block 151, the determination of the flexible cover 45 is in the closed position utilizing microprocessor 108 and encoder 117 to determine the position of the dc motor 17's shaft and thus the position of the flexible cover 45. If flexible cover 65 is not in the closed position, decision block 151 indicates that operation block 165 is performed which closes the cover. The microprocessor 108 will be programmed to close the opening by energizing the dc motor 17 with the encoder 117 and thus rolling down the flexible cover 45 to correct closed position utilizing the encoder 117 to indicate the position of the flexible cover 45 and move it to the correct closed position.

If decision block 151 indicates that the flexible cover 45 is in the correct closed position, decision block 152 determines if Infrared is detected in the IR receiver 111 in proximity sensor 21. If Infrared or movement is detected to control routine 140 goes to operational block 154. In operation block 154, microprocessor 108 sends a signal to dc motor 17 which rotates the motor gear 55 and shaft gear 56 thus rolling up the flexible cover 45 to the open position. Microprocessor 108 is programmed to perform a set amount of revolutions of the dc motor 17 to open and close the flexible cover 45 utilizing the encoder 117.

If decision block 152 does not detect infrared, the control routine 140 sends to operation block 153. Operation block 153 enters a nap mode to minimize power consumption. In the nap mode, power is not supplied to dc motor 17 or encoder 117 as an example. Power is required for the proximity sensor 21 which is constantly searching for a signal. Many proximity sensors have a sleep mode where the bare minimum power is required. Microprocessor 108 will be programmed to turn off nap mode when the infrared signal is detected thus operating the dc motor 17 to open the flexible covering 45.

After operational block 154 which opens the flexible cover, the control routine 140 goes to operational block 155. With Operational block 160, the control routine 140 determines the flexible cover 45 has fully opened or is in the opened condition. Microprocessor 108 has been programmed to open the flexible cover 45 utilizing dc motor 17 and encoder 117. The encoder 117 will provide the position of the flexible cover 45 to microprocessor 108 and when the position is in a fully open position, the power to the dc motor 17 will be stopped. In operation block 160, the control routine 140 merely determines the flexible cover 45 is in the fully open position at which operational block 161 is next.

In operational block 161, there is a set time to initiate closing of the flexible cover 45 which is programmed in microprocessor 108. In this embodiment, a set time to initiate closing of the flexible cover 45 which is 5 seconds. After the flexible cover 45 in the fully open position as determined in operational block 160, a timer is set for 5 seconds before going to decision block 163 in control routine 140.

In decision block 163, the control routine 140 determines if there is infrared detection or movement around the proximity sensor 21. If there is infrared detection or movement around the proximity sensor, the control routine goes to operational block 162. The Infrared detection determines that the user is still within the apparatus and is not ready for the closing of the flexible cover 45. In this embodiment, the proximity sensor 21 utilizes infrared but there are numerous proximity sensors such as photoelectric, inductive, ultrasonic, sonar, etc. By definition, a proximity sensor is a sensor able to detect the presence of nearby objects without any physical contact. Different types of proximity sensors can be utilized and perform similar tasks and send similar signals and this particular embodiment should not limit the scope. In the control routine 140, after decision block 163 is yes, the next step is operational block 162. In operational block 162, the timer is reinitialized to zero and starts the five-second count down and renters the control routine 140 below operational block 160. The control routine 140 resets the timer in the microprocessor 108 programming to 5 seconds to allow for additional use of the apparatus. The control routine 140 then goes to operational block 161 where the timer is set for an additional 5 seconds.

The control routine 140 indicates that if there is no Infrared is detected or no movement is detected by the proximity sensor 21 it moves to operational block 164. In operational block 164, the flexible cover 45 is lowered over the opening of the apparatus to a closed position. In microprocessor 108, the dc motor 17 will operate the set amount of revolutions as indicated by encoder 117 until it is in the closed position. The speed of rotation of the dc motor 17 can be programmed in microprocessor 108 utilizing the encoder 117. It is common to utilize encoder 117 in this manner with the dc motor 17 to control the speed if required.

Figure 8:
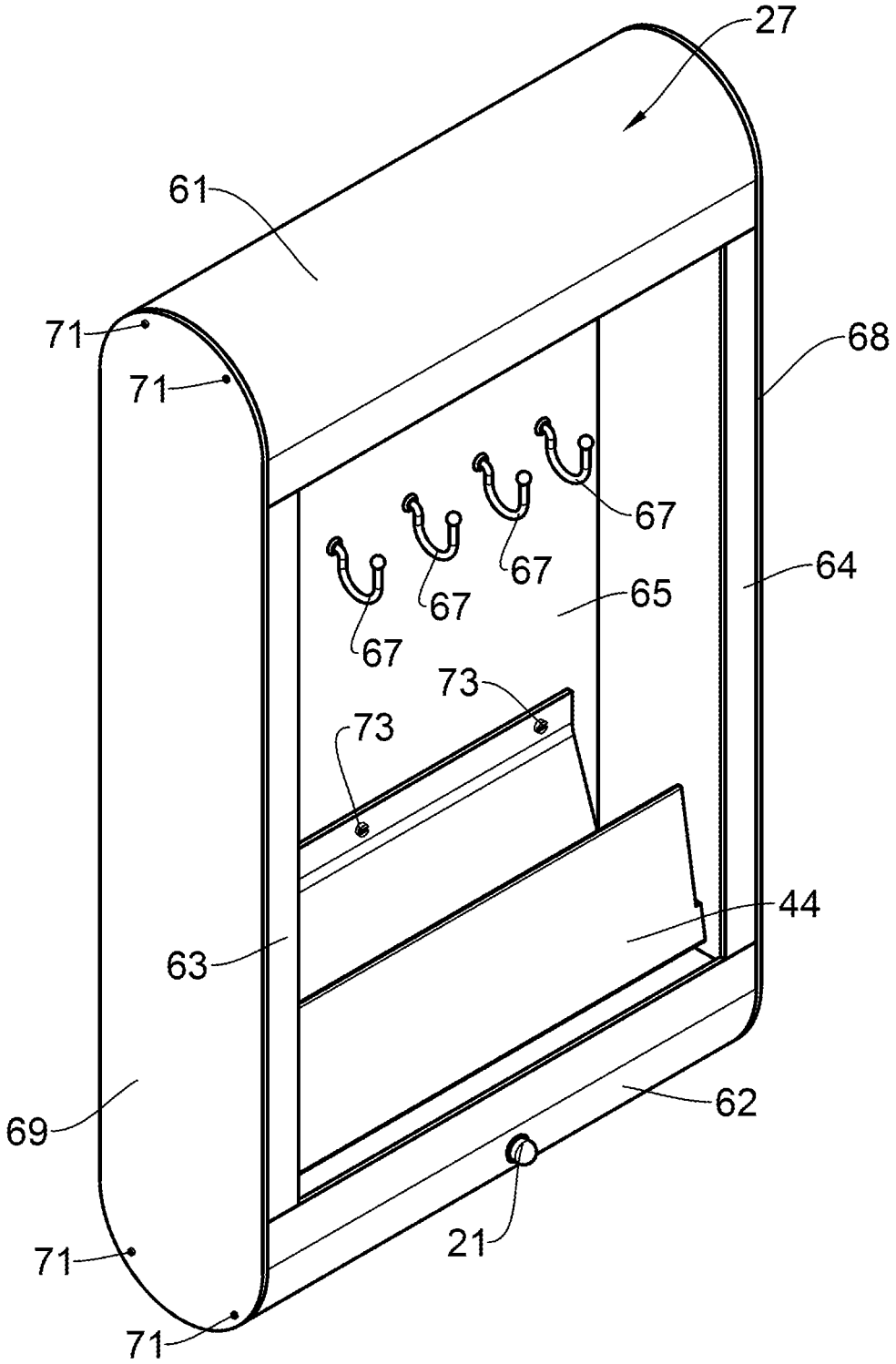
FIG. 8 illustrates a perspective view of another embodiment of the automated key and mail storage apparatus in the open condition with a plurality of key hooks as the key holding mechanism.

FIG. 8 illustrates key and mail storage apparatus 27 in perspective view with hook 67 in the place of the magnetic strip 42 as shown in FIG. 1. Hook 67 is attached to back panel 65 through holes in the back 65. Hook 67 has a threaded end such that hook nut 66 (not shown in FIG. 8 but shown in FIG. 12) is attached and secures hook 67 to back panel 65. Hook 67 can now be used to store keys by placing the keys in the hook. Other items could be placed on hook 67 such as masks.

Figure 9:
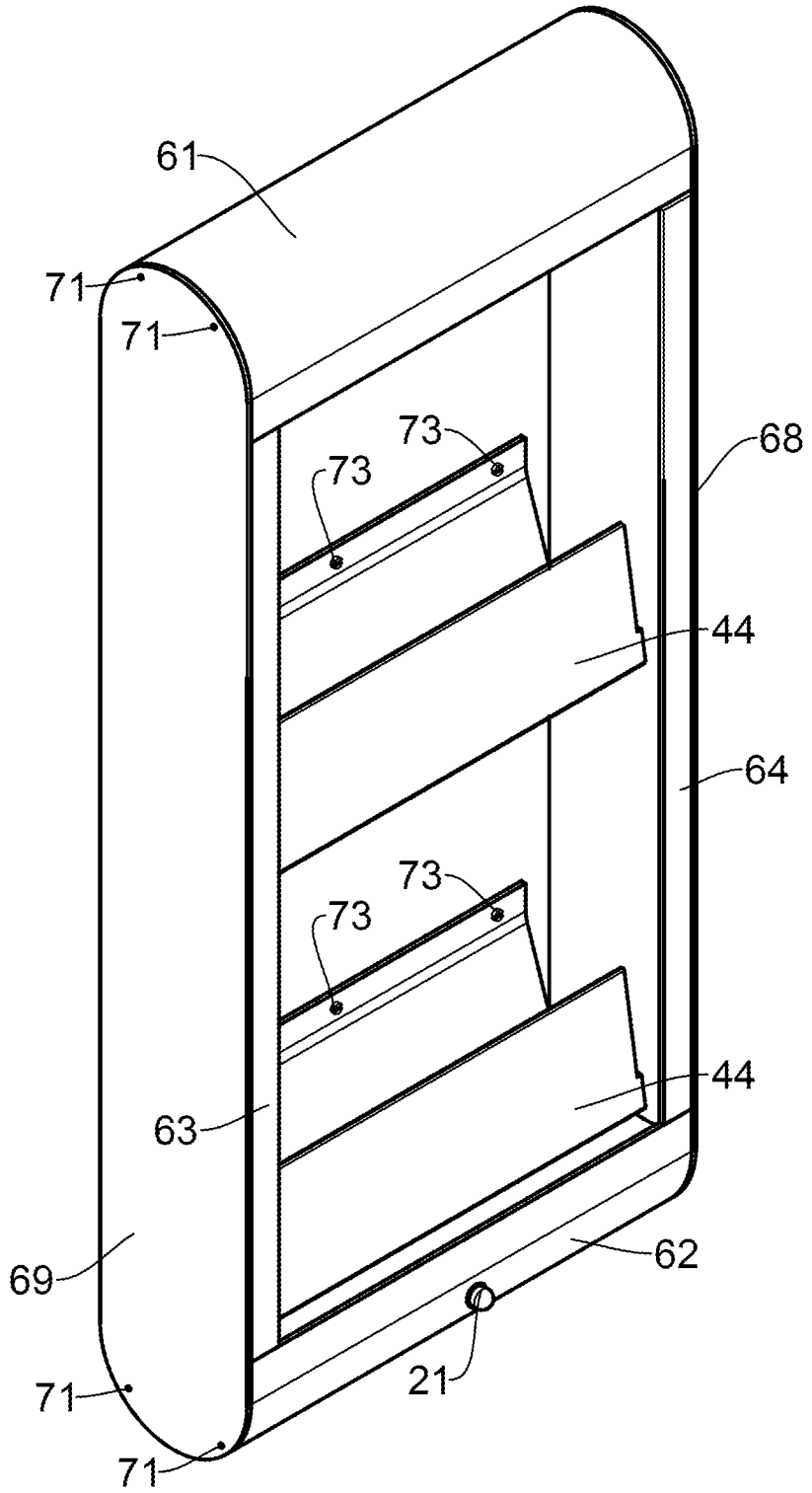
FIG. 9 illustrates a perspective view of another embodiment of the apparatus with a plurality of mail holders.

FIG. 9 illustrates a perspective view of an apparatus with a plurality of mail holders 44. In this case, the apparatus is slightly longer than key and mail storage apparatus 27 shown in FIG. 1. The components are similar, and the interactions of parts are the same as FIG. 1. The DC motor 17 will rotate the shaft 51 utilizing motor gear 56 and shaft gear 55 mechanical connection when proximity sensor 21 detects movement thus rolling up the flexible cover 45 around shaft 51 for a set amount of revolutions until it is in the open condition. The interior operating components are not shown in FIG. 9 for clarity. This embodiment is to show that additional mail holders 44 can be added for additional storage which may be desirable in some cases.

Figure 10:
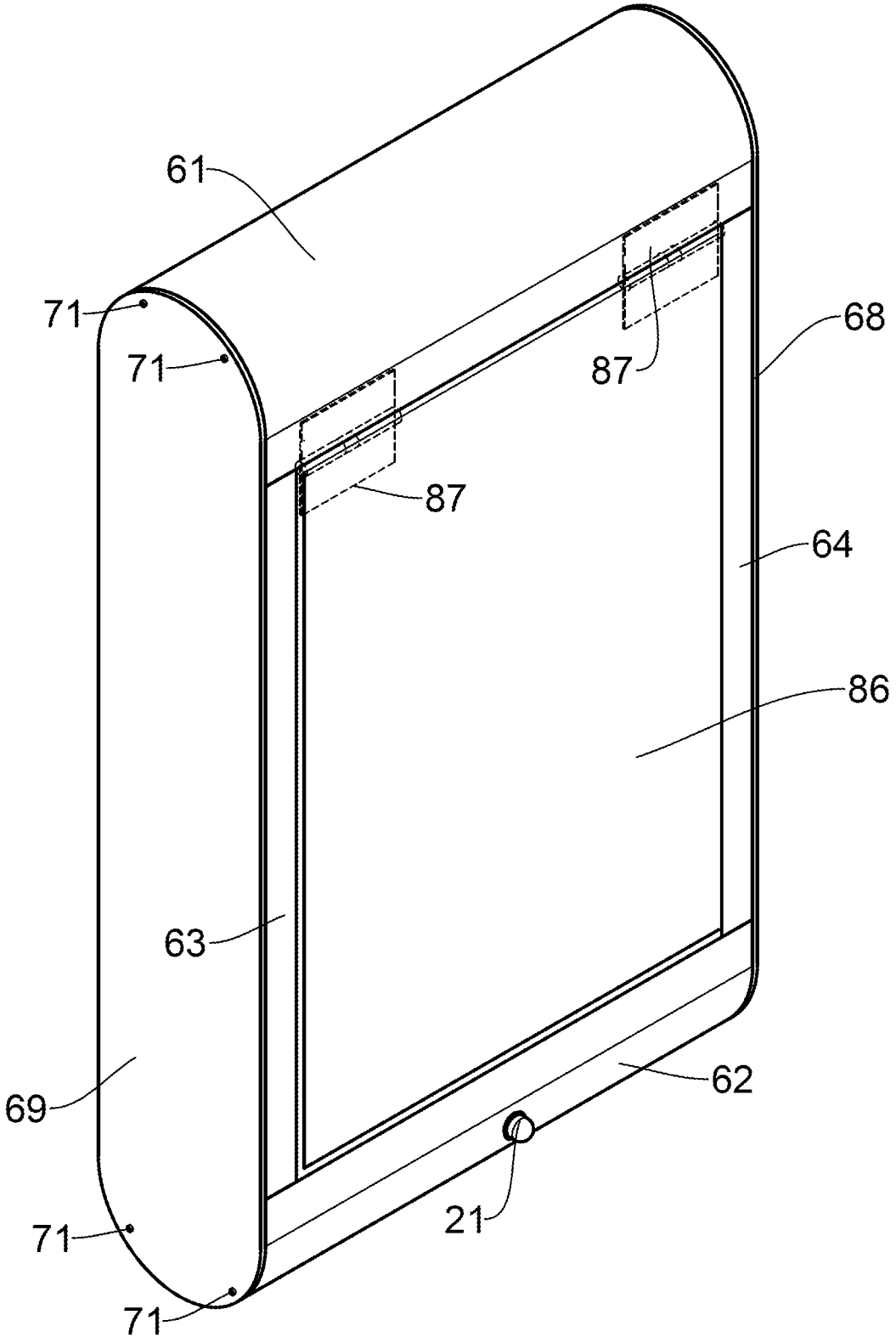
FIG. 10 illustrates the perspective view of another embodiment of the automated key and storage apparatus in the closed condition with a rigid cover.

FIG. 10. Illustrates a perspective view of an apparatus with rigid cover 86 as opposed to flexible cover 45 as shown in FIG. 2 in the closed position. The container comprises the top panel 61, the bottom panel 62 the left side panel 69, the right-side panel 68, the back panel 65 (not shown in FIG. 10), the front left panel 63, and the front right panel 64. The front panel comprises of a rigid cover 86 and two cover hinge 87. The cover hinge 87 is shown in hidden lines for illustration purposes but is shown in detail in the sequent figures. The cover hinge 87 provides pivotal movement of the rigid cover 86 from the container for keys and mail. The construction of this embodiment is similar to FIG. 3 for a container comprising of a top 61, a bottom 62, a left side 69, a right side 68, a back 65, a front left panel 63, and front right panel 64. In this embodiment, there is no dc motor 17, no shaft 51, no motor gear 56, no shaft gear 55, no left motor end bracket 57, no right motor end bracket 59, and no flexible cover 45. In subsequent Figures, the motorization of the rigid cover 86 is illustrated and described in the specifications.

Figure 11:
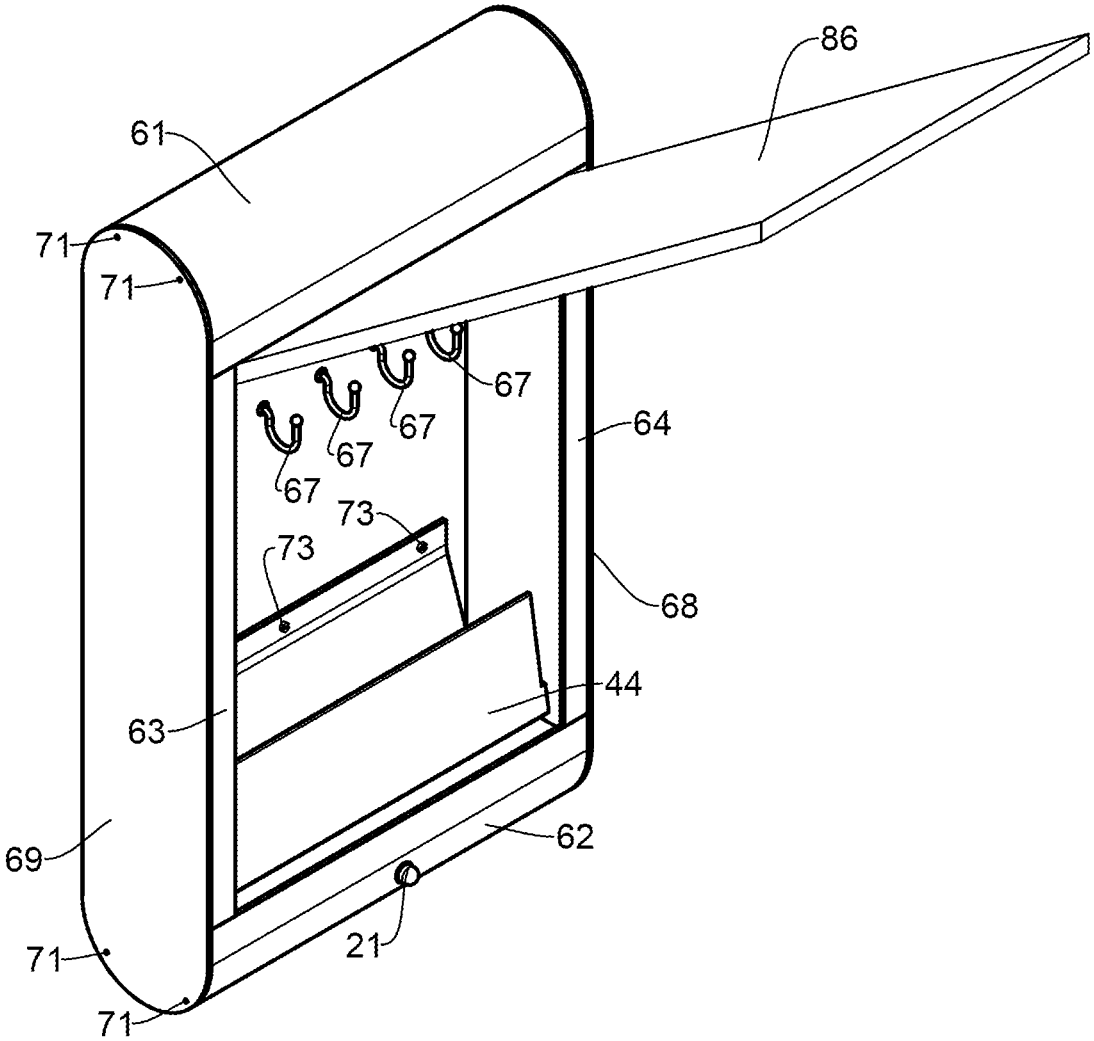
FIG. 11 illustrates the perspective view of another embodiment of the automated key and storage apparatus in the open condition with rigid cover.

FIG. 11 illustrates a perspective view of an apparatus with a rigid cover 86 in the open position. It is similar to FIG. 12 just in the open position showing mail holder 44 and hook 67 in the interior of the apparatus.

Figure 12:
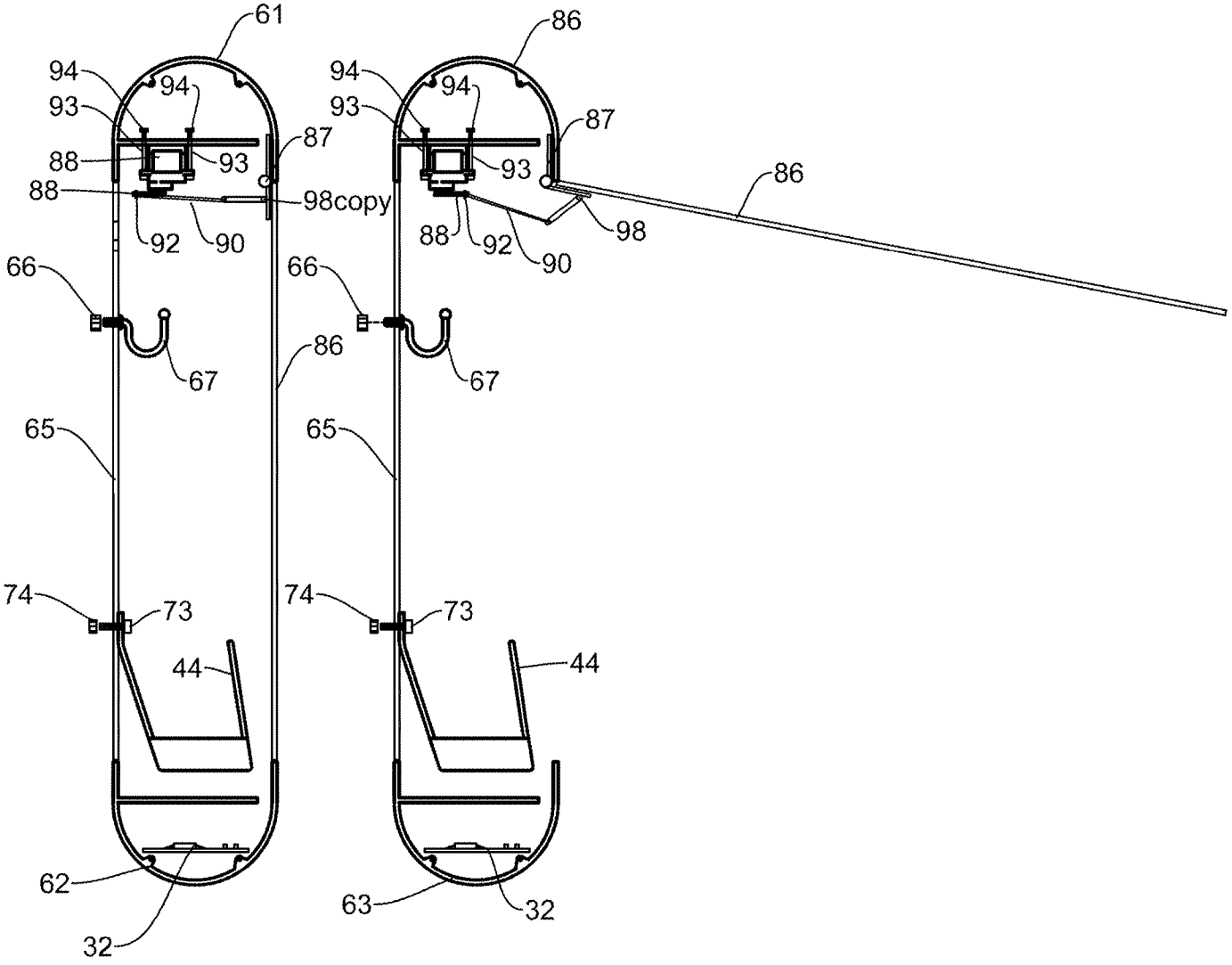
FIG. 12 illustrates a side view of another embodiment of the automated key and storage apparatus in the open and closed condition with rigid cover.

FIG. 12 illustrates the side view of the apparatus, in the open (right side of figure) and closed position (left side of figure) without a left side panel 69 attached. The mail holder 44 is connected to the back panel 65 with a mail holder screw 73 and a mail holder nut 74. The hook 66 is attached to the back panel 65 with a hook nut 66. As indicated previously, in this embodiment hook 66 has a threaded end to accept hook nut 66. In this embodiment, a servo motor 88 is attached through holes in the top panel 61 using servo motor screw 93 and servo motor nut 94. A servo motor 88 was selected for this operation since servo motors generally rotate only 360 degrees. In this application, it was desirable to use a servo motor to operate the opening and closing of the rigid cover 86 since it only needs to rotate less than 360 degrees. In addition, servo motors generally are equipped with a device that detects its position thus not requiring encoder 117 as with previous embodiments. Although a servo motor was selected in this embodiment, a dc motor could be used as well in a different configuration. A hinge 87 is glued to top panel 61 and to rigid cover 86 and is positioned to allow the rigid cover 86 to open as shown on the left side of FIG. 12. Attached to the servo motor 88 is servo motor connector 89 which is commercially available. Servo motor connector 89 is generally configured to offset the connection of servo motor 88 from its shaft. Attached to servo motor connector 89 is a linkage 90 through the use of a pin 92. Pin 92 allows the connection to rotate in the horizontal. Linkage 90 contains a pin connection that allows movement in the horizontal and vertical directions. The linkage 90 is connected to the rigid cover 86 with rigid cover pin 98. Rigid cover pin 98 can adjust in the vertical and horizontal positions. The linkage is configured to the size and movement required to open the rigid cover 86 to a specified angle as shown on the right side of FIG. 12. The rigid cover 86 is pivotally connected to the top panel 61 allowing for the rigid cover 86 to move to the open position. In this FIG. 12, the circuit board 32 is shown glued to bottom 62. The proximity sensor 21 is also located in the bottom panel 62.

The electronics and operations of the embodiment with rigid cover 86 are similar to the operations with flexible cover 45. The proximity sensor 21 will detect motion and send a signal to circuit board 32 which will be programmed to initialize the operation of servo motor 88. The servo motor 88 will rotate a set amount of degrees to move the linkage 90 and thus the rigid cover 86 to set open position. After a set amount of time and the proximity sensor 21 does not detect motion, the servo motor 88 will return to the closed position through the linkage 90 connection. As with other figures, the electrical wiring is not shown for clarity but the circuit board 32, servo motor 88, proximity sensor 21, and battery holder 47 are electrically connected.

The operation of the device is electronically using FIG. 6 and FIG. 7. The other figures illustrate the structure of the embodiments. Although the top 61 and bottom 62 are shown in a curved shape, the top panel 61 and bottom panel 62 could be rectangular or another shape. The operation of the embodiments is similar where the user waves a hand or object in front of the proximity sensor 21 which initialized the program of microprocessor 108. The program will operate a motor that will open the cover of the key and mail storage apparatus 27. After a set amount of time and there is no detection by the proximity sensor 21, the cover will close. Although, not disclosed, a light could be added that will turn on and off based on the whether there in the open or closed position. This provides an easy-to-use apparatus that will promote the use of the apparatus. If the user has several items in their hands when needing to open the apparatus, the operation allows the user to easily open the apparatus and the apparatus will close without any further action. The key and mail storage apparatus 27 provides a common location for the storage of material and keeps the material from view.

Although the automated key and mail storage apparatus has been disclosed in the context of certain embodiments and examples, it is understood by those skilled in the art that the present disclosure extends beyond the specifically disclosed embodiments to other alternative embodiments and/or uses of the automated key and mail storage apparatus and obvious modifications and equivalents thereof. In addition, several variations of the automated key and mail storage apparatus have been illustrated and described, other modifications, which are within the scope of the present disclosure, will be readily apparent to those of skill in the art. For example, a gear assembly is shown attached to the shaft 51 but one in the skill of art may attach the DC motor 17 directly connected to the shaft as opposed to using gear assembly.

It is also contemplated that various combinations of the specific features and aspects of the embodiments can be made and still fall within the scope of the present disclosure. Various features and aspects of the disclosed embodiments can be combined with or substituted for another to form varying modes of the automated key and mail storage apparatus. Thus, it is intended that the scope of the present disclosure should not be limited by the particular disclosed embodiments described above.

What is claimed is:

1. An automated key and mail storage apparatus comprising:

a housing having an interior and an open face, comprising:

a back panel;

a top panel extending from the back panel;

a bottom panel extending from the back panel;

a left side panel extending from the back panel;

a right side panel extending from the back panel;

a front left panel connected to the top panel, the bottom panel, and the left side panel; and a front right panel connected to the top panel, the bottom panel, and the right side panel;

wherein the top panel includes a first end proximately close to the left side panel and a second end proximately close to the right side panel;

wherein the bottom panel includes a proximity sensor hole;

a left motor end bracket attached to the first end of the top panel;

a right motor end bracket attached to the second end of the top panel;

a shaft supported by the left motor end bracket and the right motor end bracket;

a flexible cover attached to the shaft configured to be rolled and unrolled around the shaft;

a motor attached to the top panel and configured to rotate the shaft clockwise and counterclockwise in order to roll and unroll the flexible cover from the shaft;

a power supply attached to the bottom panel;

a circuit board attached to the bottom panel; and a proximity sensor mounted in the proximity sensor hole;

wherein the motor, the circuit board, the power supply, and the proximity sensor are electrically connected;

wherein the interior of the housing is not accessible when the flexible cover is maximally unrolled;

wherein the left motor end bracket and the right motor end bracket include a plurality of holes configured to support the shaft during rotation;

wherein the front left panel and front right panel cover respective left and right edges of the flexible cover.

2. The automated key and mail storage apparatus of claim 1, further comprising a magnetic strip attached to the back panel.

3. The automated key and mail storage apparatus of claim 1, further comprising a plurality of hooks attached to the back panel.

4. The automated key and mail storage apparatus of claim 1, further comprising one or more mail holders attached to the back panel.

5. The automated key and mail storage apparatus of claim 4, further comprising a magnetic strip attached to the back panel.

6. The automated key and mail storage apparatus of claim 4, further comprising a plurality of hooks attached to the back panel.

7. An automated key and mail storage apparatus comprising:

a housing having an interior, comprising:

a back panel;

a top panel extending from the back panel;

a bottom panel extending from the back panel;

a left side panel extending from the back panel;

a right side panel extending from the back panel;

a front left panel connected to the top panel, the bottom panel, and the left side panel;

a front right panel connected to the top panel, the bottom panel, and the right side panel;

a rigid cover connected to the top panel with a cover hinge;

wherein the bottom panel includes a proximity sensor hole;

wherein the interior of the housing is not accessible when the rigid cover is in a closed position;

a motor attached to the top panel;

a means for mechanically coupling the motor to the rigid cover;

a power supply attached to the bottom panel;

a circuit board attached to the bottom panel; and a proximity sensor mounted in the proximity sensor hole;

wherein the motor, the circuit board, the power supply, and the proximity sensor are electrically connected;

wherein the means for mechanically coupling the motor to the rigid cover allows for the opening and closing of the rigid cover.

8. The automated key and mail storage apparatus of claim 7, further comprising a magnetic strip attached to the back panel.

9. The automated key and mail storage apparatus of claim 7, further comprising a plurality of hooks attached to the back panel.

10. The automated key and mail storage apparatus of claim 7, further comprising one or more mail holders attached to the back panel.

11. The automated key and mail storage apparatus of claim 10, further comprising a magnetic strip attached to the back panel.

12. The automated key and mail storage apparatus of claim 10, further comprising a plurality of hooks attached to the back panel.

13. An automated key and mail storage apparatus comprising:

a housing formed by a back panel, a top panel, a bottom panel, and right and left side panels;

a proximity sensor;

a cover;

a motor for automating the movement of the cover; and, electronic circuitry including a microprocessor for controlling the operation of the motor;

wherein the microprocessor is configured to operably open the cover upon detecting the presence of a user via the proximity sensor and to close the cover after a predetermined period;

wherein the interior of the housing is not accessible when the rigid cover is in a closed position;

wherein the cover is flexible and attached to a shaft, the shaft being supported by a left motor end bracket and a right motor end bracket; and, wherein the motor is configured to roll and unroll the flexible cover around the shaft to respectively open and close the apparatus.

14. The automated key and mail storage apparatus of claim 13, further comprising a magnetic strip attached to the back panel.

15. The automated key and mail storage apparatus of claim 13, further comprising a plurality of hooks attached to the back panel.

16. The automated key and mail storage apparatus of claim 13, further comprising one or more mail holders attached to the back panel.

* * * * *